US008822116B2

(12) United States Patent
Niinuma et al.

(10) Patent No.: US 8,822,116 B2
(45) Date of Patent: Sep. 2, 2014

(54) ERASABLE ELECTROPHOTOGRAPHIC TONER CONTAINING ORGANIC WHITE PIGMENT AND METHOD OF PRODUCING THE SAME

(71) Applicants: Casio Electroncis Manufacturing Co., Ltd., Saitama-Ken (JP); Casio Computer Co., Ltd., Tokyo (JP)

(72) Inventors: Hideyoshi Niinuma, Hanno (JP); Hideki Ikeda, Hamura (JP); Toshiaki Kanamura, Ome (JP)

(73) Assignees: Casio Electronics Manufacturing Co., Ltd., Saitama-ken (JP); Casio Computer Co., Ltd., Tokyo (JP)

( * ) Notice: Subject to any disclaimer, the term of this patent is extended or adjusted under 35 U.S.C. 154(b) by 28 days.

(21) Appl. No.: 13/671,697

(22) Filed: Nov. 8, 2012

(65) Prior Publication Data

US 2013/0122412 A1 May 16, 2013

(30) Foreign Application Priority Data

Nov. 11, 2011 (JP) ..... 2011-247597

(51) Int. Cl.
*G03G 9/087* (2006.01)
*G03G 9/09* (2006.01)

(52) U.S. Cl.
USPC ..... 430/108.1; 430/108.21

(58) Field of Classification Search
USPC ..... 430/108.1, 108.21
See application file for complete search history.

(56) References Cited

U.S. PATENT DOCUMENTS

2012/0237868 A1* 9/2012 Yamada et al. ..... 430/108.21

FOREIGN PATENT DOCUMENTS

| | | | |
|---|---|---|---|
| EP | 0 678 790 | * | 10/1995 |
| EP | 0 542 286 | * | 7/1996 |
| EP | 0 661 598 | * | 9/1998 |
| JP | 5-61247 | A | 3/1993 |
| JP | 6-332239 | | 12/1994 |
| JP | 2000-19770 | A | 1/2000 |
| JP | 2000-239585 | | 9/2000 |
| JP | 2004-250559 | | 9/2004 |
| JP | 2008-002047 | | 1/2008 |

OTHER PUBLICATIONS

Abstract of JP 06332239 Dec. 2, 1994.*
Machine English language translation of JP 06332239 Dec. 2, 1994.*
Abstract of JP 2000239585 Sep. 5, 2000.*
Abstract of JP 2004250559 Sep. 9, 2004.*
Abstract of JP 2008002047 Jan. 10, 2008.*
Japanese Office Action dated Aug. 20, 2013 (and English translation thereof) in counterpart Japanese Application No. 2011-247597.

* cited by examiner

*Primary Examiner* — Hoa V Le
(74) *Attorney, Agent, or Firm* — Holtz Holtz Goodman & Chick, PC

(57) ABSTRACT

An erasable electrophotographic toner includes a binder resin, a near-infrared absorbing material, a decolorizing agent and an organic white pigment.

10 Claims, 2 Drawing Sheets

ERASABLE ELECTROPHOTOGRAPHIC TONER CONTAINING ORGANIC WHITE PIGMENT AND METHOD OF PRODUCING THE SAME

CROSS-REFERENCE TO RELATED APPLICATIONS

This application is based upon and claims the benefit of priority from prior Japanese Patent Application No. 2011-247597, filed Nov. 11, 2011, the entire contents of which are incorporated herein by reference.

BACKGROUND OF THE INVENTION

1. Field of the Invention

The present invention relates to an erasable electrophotographic toner containing an organic white pigment and a method of producing the same.

2. Description of the Related Art

Jpn. Pat. Appln. KOKAI Publication Nos. 05-61247 and 2000-19770 suggest a process for erasing with heat or light a print which is obtained by forming an image on a copying machine or printer using an erasable toner with an erasable leuco dye or a near-infrared light responsive erasable photosensitive toner, and thereby recycling paper. An image forming apparatus for the process comprises an erasing unit for toners inside or outside of the apparatus. In the case when the content of printed paper on which printing has been conducted by using a photosensitive toner becomes unnecessary, the paper is first subjected to erasing at the erasing unit of the apparatus to return the paper to a printable state, thereby the paper can be used again.

For erasing a letter or the like printed on paper, it is sufficient to erase the color of a toner that forms the letter, which is performed by subjecting the paper to erasing by a certain kind of process. According to the current needs, complete erasing with saved energy and on high-speed on demand is required. In order to meet these requirements, it is necessary that a toner has high erasability and superior visibility after erasing, in other words, the color difference between the color of an image after erasing and the color of base paper is reduced.

However, conventional photosensitive toners had a defect that the pre-erasing printed information can be recognized after erasing since the erasing is insufficient, and thus a shade remains or yellowing occurs after erasing. In such cases, recycling of paper may be interfered, or the pre-erasing information may be restored easily to cause leakage of information.

BRIEF SUMMARY OF THE INVENTION

The present invention has been made in view of the above-mentioned circumstance, and it is an object of the present invention to provide an erasable electrophotographic toner that can improve the visibility after erasing and can make it difficult to identify and restore the pre-erasing printed information after erasing, and a method of producing the same.

According to the first embodiment of the present invention, there is provided an erasable electrophotographic toner comprising a binder resin, a near-infrared absorbing material, a decolorizing agent and an organic white pigment.

According to the second embodiment or the present invention, there is provided a method of producing an erasable electrophotographic toner, comprising mixing a binder resin, a near-infrared absorbing material and a decolorizing agent, melt-kneading the mixture obtained by the mixing, and adding an organic white pigment to the melt-kneaded mixture.

DETAILED DESCRIPTION OF THE INVENTION

Figure 1:
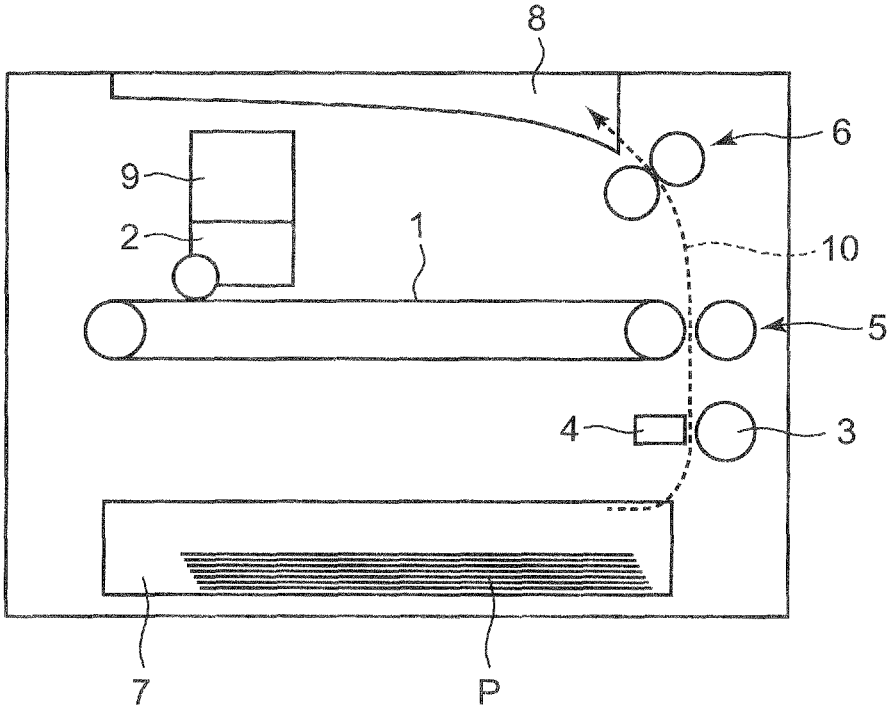
FIG. 1 is a drawing showing a printer having an erasing function which is configured to erase and regenerate a transfer medium that has been printed using the erasable electrophotographic toner according to one embodiment of the present invention and to conduct printing again.

Hereinafter various embodiments of the present invention will be explained.

The erasable electrophotographic toner according to one embodiment of the present invention is obtained by mixing, melt-kneading and pulverizing a binder resin, a near-infrared absorbing material, a decolorizing agent and a charge controlling agent. During the mixing and/or the melt-kneading of the binder resin, near-infrared absorbing material, decolorizing agent and charge controlling agent, an organic white pigment is added in an amount of from 5 to 20% by mass of the mass of the toner.

Generally, a binder resin in a toner after erasing has a conventional resin color, and an image or print after erasing turns slightly yellow. Similarly, a material in a toner turns slightly yellow after erasing. On the other hand, it is expected that an organic white pigment produces an effect to suitably conceal an image or print after erasing to minimize the appearance of yellowing of a printed part after erasing. Actually, the organic white pigment could suppress the yellowing of the printed part after erasing. As a result, the organic white pigment was effective for improving the visibility after erasing. Furthermore, since the organic white pigment dose not contain metal atoms, the balance of charging is not disrupted.

Meanwhile, an inorganic white pigment such as titanium oxide or zinc oxide cannot be used since they have too high concealing ability and thus obstruct the incidence of erasing light to make erasing difficult.

In contrast, the organic white pigment makes erasing easy since it does not easily obstruct the incidence of erasing light. Furthermore, since the organic white pigment is a material in which visible light is almost perfectly reflected, it has a high degree of whiteness and a good concealing property. Furthermore, since the organic white pigment is an organic compound, it has a lower specific gravity than that of an inorganic-based compound. For example, titanium oxide has a specific gravity of 3.9, whereas the organic white pigment has specific gravity of 1.4 or the like. Furthermore, the organic pigment is more excellent than an inorganic pigment in toxicity, coloring property, color vividness and the like, in addition to specific gravity. The organic pigment is a coloring material that is chemically produced by synthesizing a material. In the erasable electrophotographic toner according to the present embodiment, a diphenylethylene-based compound, an ethylenediamine-based compound, a bis-styryl-based compound and the like are preferably used as the organic white pigment. Alternatively, it is also possible to use an alkylene-bis-melamine derivative, an ethylene-bis-melamine derivative and the like, as described in Jpn. Pat. Appln. KOKAI Publication Nos. 6-122674 and 2004-269576.

Among these organic white pigments, the diphenylethylene-based compound is especially preferable. Specific examples of the diphenylethylene-based compound can include "Shigenox F" (manufactured by Hakkol Chemical Co., Ltd.).

When a print or image is formed by an electrophotographic process using the above erasable electrophotographic toner, the print, or image has a high image concentration under visible light, whereas the print or image is erased by irradiation with near-infrared light. This is based on the following phenomenon.

Specifically, when the print or image is irradiated with near-infrared light, the near-infrared absorbing material in the toner is put into an excited state and reacts with the decolorizing agent to cause an erasing phenomenon. As a result, the print or image is erased, thereby it becomes possible to recycle a transfer medium.

In the erasable electrophotographic toner according to the present embodiment, an organic white pigment is added in an amount of from 5 to 20% by mass of the mass of the toner during the mixing and/or melt-kneading of the raw materials. Therefore, it is possible to improve the visibility after erasing and make it difficult to identify and restore the pre-erasing printed information after erasing.

The organic white pigment is added in an amount of preferably from 5 to 20% by mass, and most preferably about 10% by mass of the mass of the toner.

In the case when the addition amount of the organic white pigment is less than 5% by mass or more than 20% by mass of the mass of the toner, the effect of addition of the organic white pigment is not produced, and the binder resin in the toner after erasing has a conventional resin color and the image or print after erasing becomes slightly yellow. As a result, the pre-erasing printed information is identified and restored after erasing.

An erasing reaction is caused by binding of a material cation of the near-infrared absorbing material to an alkyl group of the depolarizing agent. The ratio of the near-infrared absorbing material to decolorizing agent in the erasable toner is suitably selected so that an unreacted near-infrared absorbing material does not remain after the erasing reaction.

Infrared light refers to general electromagnetic radiation having a longer wavelength than that of red light and a shorter wavelength than that of millimeter-wavelength electromagnetic radiation, and the wavelength thereof is distributed from about 0.7 μm to 1 mm (=1,000 μm). Of infrared light, light with a short wavelength of about 0.7 to 2.5 μm is generally referred to as near-infrared light. A near-infrared absorbing material and a derivative thereof have the maximum absorption wavelength at about 817 to 822 nm and a molar absorption coefficiency of about $1\times10^5$. The molar absorption coefficiency is a unit that is used as an index for showing the degree of light absorption by a substance, which is represented by a reciprocal of a ratio of light intensity (transmittance) when light passes a 1 M solution having a thickness of 1 cm. Furthermore, some near-infrared absorbing rays and derivatives thereof have a second absorption band at about 640 nm. In the erasable toner according to the present embodiment, a conventionally-known near-infrared absorbing material can be used. Examples of the near-infrared absorbing material include those described in Jpn. Pat. Appln. KOKAI Publication Nos. 4-362935 and 5-119520. Specific examples of the near-infrared absorbing material include IRT (trade name, manufactured by Showa Denko K. K.) as shown in the following formula:

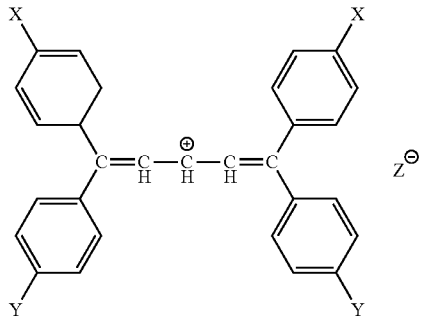

where X and Y are both $N(C_2H_5)_2$, and $Z^-$ is a counterion represented by the following formula:

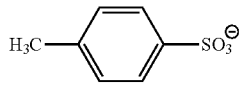

The decolorizing agent is a material that erases the color of a cyan-based material, and the color becomes not a complete white color but a pale yellow color after erasing. As the decolorizing agent, a conventionally-known quaternary ammonium boron complex can be used. Examples of the quaternary ammonium boron complex include those described in Jpn. Pat. Appln. KOKAI Publication Nos. 4-362935 and 5-119520. Specific examples of the quaternary ammonium boron complex include P3B (trade name, manufactured by Showa Denko K. K.) as shown in the following formula. By using the near-infrared absorbing material and a specific organic boron compound in combination, a polymerization function or erasing function can be expressed.

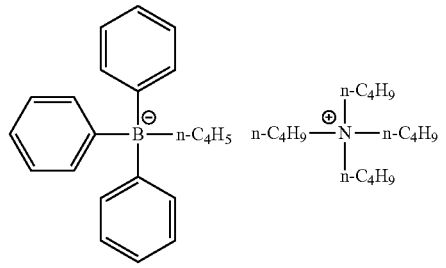

The binder resin is a resin that is a main component of the toner. The binder resin can be selected from a wide range including known ones. Specific examples thereof include styrene-based resins such as polystyrenes, styrene-acrylic acid ester copolymers, styrene-methacrylic acid copolymers and styrene-butadiene copolymers; as well as saturated polyester resins, unsaturated polyester resins, epoxy resins, phenol resins, coumarone resins, xylene resins, vinyl chloride resins, polyolefin resins, polycarbonates, polyurethanes and the like. Two or more kinds of these resins may be used in combination. Among these resins, polyester-based resins are preferable in view of charging property, durability, color developing property, adhesion to paper and the like.

As the charge controlling agent (electrical charge controlling agent), any agent which is usually used in electrophotographic toners can be used. A known charge controlling agent can be used, and one that provides a high charging speed and can stably maintain a constant charge amount is particularly preferable. Examples of the charge controlling agent (electrical charge controlling agent) for controlling the toner to have negative charge include the following: polymers or copolymers having a sulfonic acid group, sulfonate group or sulfonic acid ester group, salicylic acid derivatives and metal complexes thereof, monoazo metal compounds, acetylacetone metal compounds, aromatic oxycarboxylic acids, aromatic mono and polycarboxylic acids, and metal salts, anhydrides and esters thereof, phenol derivatives such as bisphenol, urea derivatives, metal-containing naphthoic acid-based compounds, boron compounds, quaternary ammonium salts, calixarene, resin-based electrical charge controlling agents, and the like. Specific examples thereof include Spilon Black TRH, T-77, T-95 and TN-105 (Hodogaya Chemical Co., Ltd.), BONTRON (registered trademark.) S-34, S-44, S-54, E-84, E-88 and E-89 (Orient Chemical Industries Co., Ltd.), LR-147 (Japan Carlit Co., Ltd.), and the like.

The erasable toner according to one embodiment of the present invention can contain a release agent in addition to the binder resin, near-infrared absorbing material, decolorizing agent, charge controlling agent and organic white pigment. As the release agent, any agent that is usually used in electrophotographic toners can be used.

Hereinafter a printer having an erasing function which is configured to erase and regenerate a transfer medium that has been printed using the above erasable electrophotographic toner and to conduct printing again will be explained with referring to the drawings.

The printer shown in FIG. 1 was produced by modifying a commercially available printer (N3500: manufactured by Casio Computer Co., Ltd.) In this printer, a photosensitive toner developing unit 2, an erasing heater 3, an erasing LED head 4, a transfer unit 5, and a fixing unit 6 are disposed around a print belt 1. A cassette 7 for housing a transfer medium P that has been printed using a photosensitive toner is disposed on the bottom of this printer. A paper ejection unit 8 for ejecting the transfer medium that has been printed again using the photosensitive toner is disposed on the upper part of this printer. A photosensitive toner cartridge 9 for housing the photosensitive toner is attached to the photosensitive toner developing unit 2.

The printer shown in FIG. 1 is operated as follows.

First, the transfer medium P that has been printed using the photosensitive toner is taken out of the cassette 7, and passed the respective units along a transfer medium pathway 10. More specifically, the transfer medium P is heated and irradiated with near-infrared light by the erasing heater 3 and erasing LED head 4, thereby the print is erased. Next, at the transfer unit 5, a developed image of the photosensitive toner is transferred to the transfer medium on which the print has been erased. The developed image of the photosensitive toner is an image that has been developed by the photosensitive toner developing unit 2 using the photosensitive toner supplied by the photosensitive toner cartridge 9, and then has been sent to the transfer unit 5 by the print belt 1.

The image of the photosensitive toner that has been transferred at the transfer unit 5 is further sent to the fixing unit 6 along the transfer medians pathway 10, where a fixing treatment is conducted, and then the paper is ejected to the paper ejection unit 8, thereby the operations are completed.

In the above-mentioned operations of the printer, the output of the erasing LED head (halogen lamp head) 4 was 50 $mW/cm^2$, and the temperature of the erasing heater 3 was 100° C. The transfer speed of the transfer medium pathway 10 can be changed to any appropriate speed.

Hereinafter, the effect of the present invention will be explained specifically with referring to Examples and Comparative Examples of the present invention.

Example 1

The photosensitive toner was prepared as follows.

A raw material consisting of 1.5 parts by mass of infrared photosensitive dye "IRT" having sensitivity at a wavelength of 817 nm (manufactured by Showa Denko K. K.), 7.5 parts by mass of organic boron compound decolorizing agent "P3B" (manufactured by Showa Denko K. K.), 82.0 parts by mass of a polyester binder resin for toners (manufactured by Kao Corp.), 1.5 parts by mass of negative electrical charge controlling agent "LR-147" (manufactured by Japan Carlit Co., Ltd.), 2.5 parts by mass of Carnauba Wax No. 1 powder (imported by S. Kato & Co.) and 5.0 parts by mass of organic white pigment "Shigenox F" (manufactured by Hakkol Chemical Co., Ltd.) was put into a Henschel mixer (manufactured by Mitsui Mining Company, Ltd.) and mixed.

Then, the mixture was melt-kneaded in a biaxial kneader. The obtained kneaded product was then cracked in Rotoplex (manufactured by Hosokawa Micron Corp.) to give a cracked product. The obtained cracked product was pulverized in a collision-type pulverizer so as to have an average particle diameter of 9 μm. One part by mass of silica "R972" (manufactured by Nippon Aerosil Co., Ltd.) was added as an external additive to 100 parts by mass of the obtained pulverized product, and the mixture was mixed in the Henschel mixer to obtain a photosensitive toner.

Example 2

A photosensitive toner was prepared in a similar manner to that of Example 1, except that 77.0 parts by mass of the polyester binder resin for toners was used, and that 10.0 parts by mass of the organic white pigment "Shigenox F" was used.

Example 3

A photosensitive toner was prepared in a similar manner to that of Example 1, except that 72.0 parts by mass of the polyester binder resin for toners was used, and that 15.0 parts by mass of the organic white pigment "Shigenox F" was used.

Example 4

A photosensitive toner was prepared in a similar manner to that of Example 1, except that 67.0 parts by mass of the polyester hinder resin for toners was used, and that 20.0 parts by mass of the organic white pigment "Shigenox F" was used.

Example 5

A photosensitive toner was prepared in a similar manner to that of Example 1, except that 5.0 parts by mass of "Shigenox OWP" (manufactured by Hakkol Chemical Co., Ltd.) was used as the organic white pigment instead of "Shigenox F".

Example 6

A photosensitive toner was prepared in a similar manner to that of Example 1, except that 77.0 parts by mass of the polyester binder resin for toners was used, and that 10.0 parts by mass of "Shigenox OWP" (manufactured by Hakkol Chemical Co., Ltd.) was used as the organic white pigment instead of "Shigenox F".

Example 7

A photosensitive toner was prepared in a similar manner to that of Example 1, except that 72.0 parts by mass of the polyester binder resin for toners was used, and that 15.0 parts by mass of "Shigenox OWP" (manufactured by Hakkol Chemical Co., Ltd.) was used as the organic white pigment instead of "Shigenox F".

Example 8

A photosensitive toner was prepared in a similar manner to that of Example 1, except that 67.0 parts by mass of the polyester binder resin for toners was used, and that 20.0 parts by mass of "Shigenox OWP" (manufactured by Hakkol Chemical Co., Ltd.) was used as the organic: white pigment instead of "Shigenox F".

Example 9

A photosensitive toner was prepared in a similar manner to that of Example 1, except that 82.0 parts by mass of the polyester binder resin for toners was used, and that 5.0 parts by mass of "Shigenox U" (manufactured by Hakkol Chemical Co., Ltd.) was used as the organic white pigment instead of "Shigenox F".

Example 10

A photosensitive toner was prepared in a similar manner to that of Example 1, except that 77.0 parts by mass of the polyester binder resin for toners was used, and that 10.0 parts by mass of "Shigenox U" (manufactured by Hakkol Chemical Co., Ltd.) was used as the organic white pigment instead of "Shigenox F".

Example 11

A photosensitive toner was prepared in a similar manner to that of Example 1, except that 72.0 parts by mass of the polyester binder resin for toners was used, and that 15.0 parts by mass of "Shigenox U" (manufactured by Hakkol Chemical Co., Ltd.) was used as the organic white pigment instead of "Shigenox F".

Example 12

A photosensitive toner was prepared in a similar manner to that of Example 1, except that 67.0 parts by mass of the polyester binder resin for toners was used, and that 20.0 parts by mass of "Shigenox U" (manufactured by Hakkol Chemical Co., Ltd.) was used as the organic white pigment instead of "Shigenox F".

Example 13

A photosensitive toner was prepared in a similar manner to that of Example 1, except that a raw material consisting of leuco dyes: 3.5 parts by mass of "CVL" and 0.5 parts by mass of "S-205" (manufactured by Yamada Kagaku Co., Ltd.); developers: 1.5 parts by mass of "24DHBP" (manufactured by Sankyo Kasei Co., Ltd.) and 1.5 parts by mass of "244THBP" (manufactured by Sankyo Kasei Co., Ltd.); 65.0 parts by mass of hinder resin "PTR7734" (manufactured by Eliokem); 13.0 parts by mass of tackifier "FTR-2140" (manufactured by Mitsui Chemicals, Inc.); 1.0 part by mass of negative electrical charge controlling agent "LR-147" (manufactured by Japan Carlit Co., Ltd.); 4.0 parts by mass of Bischol 660P (manufactured by Sanyo Kasei Co., Ltd.) and 10.0 parts by mass of organic white pigment "Shigenox F" (manufactured by Hakkol Chemical Co., Ltd.) was used.

Example 14

A photosensitive toner was prepared in a similar manner to that of Example 13, except that 2.0 parts by mass of "24DHBP" and 1.0 part by mass of "244THBP" were used.

Example 15

A photosensitive toner was prepared in a similar manner to that of Example 13, except that 4.0 parts by mass of "24DHBP" and 1.0 part by mass of "244THBP" were used, and that 63.0 parts by mass of "PTR7734" was used.

Example 16

A photosensitive toner was prepared in a similar manner to that of Example 1, except that a raw material consisting of 2.0 parts by mass of leuco dye "CVL", 2.0 parts by mass of developer "propyl gallate", 85.0 parts by mass of hinder resin "SE-130" (manufactured by Sanyo Chemical Industries, Ltd.), 1.0 part by mass of negative electrical charge controlling agent "LR-147" (manufactured by Japan Carlit Co., Ltd.) and 10.0 parts by mass of organic white pigment "Shigenox F" (manufactured by Hakkol Chemical Co., Ltd.) was used.

Example 17

A photosensitive toner was prepared in a similar manner to that of Example 1, except that a raw material consisting of 2.0 parts by mass of leuco dye "3-(4-dimethylamino-2-ethoxyphenyl)-3-(1-ethyl-2-methylindol-3-yl)-4-azaphthalide", 2.0 parts by mass developer "propyl gallate", 85.0 parts by mass of binder resin "styrene-butyl acrylate copolymer (acrylate content ratio: 6.0 parts by mass)", 1.0 part by mass of negative electrical charge controlling agent "LR-147" (manufactured by Japan Carlit Co., Ltd.) and 10.0 parts by mass of organic white pigment "Shigenox F" (manufactured by Hakkol Chemical Co., Ltd.) was used.

Example 18

A photosensitive toner was prepared in a similar manner to that of Example 1, except that a raw material consisting of 4.2 parts by mass of leuco dye "Blue203", 6.6 parts by mass of a developer "24DHBP" (manufactured by Sankyo Kasei Co., Ltd.), 73.2 parts by mass of binder resin "styrene-butyl acrylate copolymer (acrylate content ratio: 6.0 parts by mass)", 1.0 part by mass of negative electrical charge controlling agent "LR-147" (manufactured by Japan Carlit Co., Ltd.), 5.0 parts by mass of "polypropylene wax" and 10.0 parts by mass of organic white pigment "Shigenox F" (manufactured by Hakkol Chemical Co., Ltd.) was used.

Example 19

A photosensitive toner was prepared in a similar manner to that of Example 1, except that a raw material consisting of 2.0 parts by mass of leuco dye "CVL", 2.0 parts by mass of developer "propyl gallate", 16.0 parts by mass of decolorizing agent "cholic acid", 68.0 parts by mass of binder resin "SB-130" (manufactured by Sanyo Chemical Industries, Ltd.), 1.0 part by mass of negative electrical charge controlling agent "LR-147" (manufactured by Japan Carlit Co., Ltd.), 1.0 part by mass of "polypropylene wax" and 10.0 parts by mass of organic white pigment "Shigenox F" (manufactured by Hakkol Chemical Co., Ltd.) was used.

Example 20

A photosensitive toner was prepared in a similar manner to that of Example 1, except that a raw material consisting of 2.0 parts by mass of leuco dye "CVL", 2.0 parts by mass of developer "propyl gallate", 84.0 parts by mass of binder resin "SB-130" (manufactured by Sanyo Chemical Industries, Ltd.), 1.0 part by mass of negative electrical charge controlling agent "LR-147" (manufactured by Japan Carlit Co., Ltd.), 1.0 part by mass of "polypropylene wax" and 10.0 parts by mass of organic white pigment "Shigenox F" (manufactured by Hakkol Chemical Co., Ltd.) was used.

Example 21

A photosensitive toner was prepared in a similar manner to that of Example 1, except that a raw material consisting of 2.0 parts by mass of leuco dye "3-(4-dimethylamino-2-ethoxyphenyl)-3-(1-ethyl-2-methylindol-3-yl)-4-azaphthalide", 2.0 parts by mass of developer "propyl gallate", 84.0 parts by mass of binder resin "styrene-butyl acrylate copolymer (acrylate content ratio: 6.0 parts by mass)", 1.0 part by mass of negative electrical charge controlling agent "LR-147" (manufactured by Japan Carlit Co., Ltd.), 1.0 part by mass of "polypropylene wax" and 10.0 parts by mass of organic white pigment "Shigenox F" (manufactured by Hakkol Chemical Co., Ltd.) was used.

Comparative Example 1

A photosensitive toner was prepared in a similar manner to that of Example 1, except that a raw material consisting of 1.5 parts by mass of infrared photosensitive dye "IRT" (manufactured by Showa Denko K. K.), 7.5 parts by mass of organic boron compound decolorizing agent "P3B" (manufactured by Showa Denko K. K.), 87.0 parts by mass of the polyester binder resin for toners (manufactured by Kao Corp.), 1.5 parts by mass of negative electrical charge controlling agent "LR-147" (manufactured by Japan Carlit Co., Ltd.) and 2.5 parts by mass of Carnauba Wax No. 1 powder (imported by S. Kato & Co.) was used.

Comparative Example 2

A photosensitive toner was prepared in a similar manner to that of Example 1, except that a raw material consisting of 1.5 parts by mass of infrared photosensitive dye "IRT" (manufactured by Showa Danko K. K.), 7.5 parts by mass of organic boron compound decolorizing agent "P3B" (manufactured by Showa Denko K. K.), 82.0 parts by mass of the polyester binder resin for toners (manufactured by Kao Corp.), 1.5 parts by mass of negative electrical charge controlling agent "LR-147" (manufactured by Japan Carlit Co., Ltd.), 2.5 parts by mass of Carnauba Wax No. 1 powder (imported by S. Kato & Co.) and 5.0 parts by mass of titanium oxide "TAF-520" (manufactured by Fuji Titanium Industry Co., Ltd.) was used.

Comparative Example 3

A photosensitive toner was prepared in a similar manner to that of Comparative Example 2, except that 86.0 parts by mass of the polyester hinder resin for toner (manufactured by Kao Corp.) was used, and that 1.0 part by mass of titanium oxide "TAF-520" (manufactured by Fuji Titanium Industry Co., Ltd.) was used.

Comparative Example 4

A photosensitive toner was prepared in a similar manner to that of Example 1, except that a raw material consisting of 1.5 parts by mass of infrared photosensitive dye "IRT" (manufactured by Showa Denko K. K.), 7.5 parts by mass of organic boron compound decolorizing agent "P3B" (manufactured by Showa Danko K. K.), 83.0 parts by mass of the polyester binder resin for toners (manufactured by Kao Corp.), 1.5 parts by mass of negative electrical charge controlling agent "LR-147" (manufactured by Japan Carlit Co., Ltd.), 2.5 parts by mass of Carnauba Wax No. 1 powder (imported by S. Kato & Co.) and 4.0 parts by mass of organic white pigment "Shigenox F" (manufactured by Hakkol Chemical Co., Ltd.) was used.

Comparative Example 5

A photosensitive toner was prepared in a similar manner to that of Example 1, except that a raw material consisting of 1.5 parts by mass of infrared photosensitive dye "IRT" (manufactured by Showa Denko K. K.), 7.5 parts by mass of organic boron compound decolorizing agent "P3B" (manufactured by Showa Denko K. K.), 66.0 parts by mass of the polyester binder resin for toners (manufactured by Kao Corp.), 1.5 parts by mass of negative electrical charge controlling agent "LR-147" (manufactured by Japan Carlit Co., Ltd.), 2.5 parts by mass of Carnauba Wax No. 1 powder (imported by S. Kato & Co.) and 21.0 parts by mass of organic white pigment "Shigenox F" (manufactured by Hakkol Chemical Co., Ltd.) was used.

Comparative Example 6

A photosensitive toner was prepared in a similar manner to that of Example 1, except that a raw material consisting of leuco dyes: 3.5 parts by mass of "CVL" and 0.5 parts by mass of "S-205" (manufactured by Yamada Kagaku Co., Ltd.); developers: 1.5 parts by mass of "24DHBP" (manufactured by Sankyo Kasei Co., Ltd.) and 1.5 parts by mass of "244THBP" (manufactured by Sankyo Easel Co., Ltd.); 73.0 parts by mass of binder resin "PTR7734" (manufactured by Eliokem); 15.0 parts by mass of tackifier "FTR-2140" (manufactured by Mitsui Chemicals, Inc.); 1.0 part by mass of negative electrical charge controlling agent "LR-147" (manufactured by Japan Carlit Co., Ltd.) and 4.0 parts by mass of Bischol 660P (manufactured by Sanyo Kasei Co., Ltd.) was used.

The organic white pigments and titanium oxide used in the above-mentioned Examples and Comparative Examples are listed in the following Table 1.

Furthermore, the toner composition used in the above-mentioned Examples and Comparative Examples are shown in the following Tables 2 and 3.

TABLE 1

| | Manufacturer | Name | Type |
|---|---|---|---|
| Organic | Hakkol chemical Co., Ltd. | Shigenox F | Diphenylethylene-type compound |
| white pigment | Hakkol chemical Co., Ltd. | Shigenox OWP | Ethylenediamine-type compound |
| | Hakkol chemical Co., Ltd. | Shigenox U | Bis-styryl-type compound |
| Titanium oxide | Fuji titanium industry Co., Ltd. | TAF-520 | |

TABLE 2

| | Name | Manufacturer | Example 1 | Example 2 | Example 3 | Example 4 | Example 5 | Example 6 | Example 7 |
|---|---|---|---|---|---|---|---|---|---|
| Dye | IRT | Showa Denko K.K. | 1.5 | 1.5 | 1.5 | 1.5 | 1.5 | 1.5 | 1.5 |
| | CVL | | | | | | | | |
| | S-205 (2-Anilino-6-(N-ethyl-N-isobutylamino)-3-methylfluoran | Yamada Kagaku Co., Ltd. | | | | | | | |
| | 3-(4-Dimethylamino-2-ethoxyphenyl)-3-(1-ethyl-2-methylindol-3-yl)-4-azaphthalide | | | | | | | | |
| | Blue203 | | | | | | | | |
| Developer | 24DHBP | Sankyo Kasei Co., Ltd. | | | | | | | |
| | 244THBP | Sankyo Kasei Co., Ltd. | | | | | | | |
| | Propyl gallate | | | | | | | | |
| Decolorizing agent | P3B | Showa Denko K.K. | 7.5 | 7.5 | 7.5 | 7.5 | 7.5 | 7.5 | 7.5 |
| | Cholic acid | | | | | | | | |
| Wax | Carnauba No. 1 | | 2.5 | 2.5 | 2.5 | 2.5 | 2.5 | 2.5 | 2.5 |
| | Bischol 660P | Sanyo Kasei Co., Ltd. | | | | | | | |
| | Polypropylene wax | | | | | | | | |
| Charge controlling agent | LR147 | Japan Carlit Co., Ltd. | 1.5 | 1.5 | 1.5 | 1.5 | 1.5 | 1.5 | 1.5 |
| Resin | Binder resin for toners | Kao Corp. | 82.0 | 77.0 | 72.0 | 67.0 | 82.0 | 77.0 | 72.0 |
| | PTR7734 | Eliokem | | | | | | | |
| | FTR-2140 | Mitsui Chemicals, Inc. | | | | | | | |
| | SB-130 | Sanyo Chemical Industries, Ltd. | | | | | | | |
| | Styrene-butyl acrylate copolymer (acrylate content: 6 parts by mass) | | | | | | | | |
| Organic white pigment | Shienox F | Hakkol Chemical Co., Ltd. | 5.0 | 10.0 | 15.0 | 20.0 | | | |
| | Shienox OWP | Hakkol Chemical Co., Ltd. | | | | | 5.0 | 10.0 | 15.0 |
| | Shienox U | Hakkol Chemical Co., Ltd. | | | | | | | |
| Titanium oxide | TAF-520 | Fuji Titanium Industry Co., Ltd. | | | | | | | |
| Silica | R972 | Nippon Aerosil Co., Ltd. | 1.0 | 1.0 | 1.0 | 1.0 | 1.0 | 1.0 | 1.0 |
| | Hydrophobic silica (/100 parts by mass) | | | | | | | | |

| | Name | Example 8 | Example 9 | Example 10 | Example 11 | Example 12 | Example 13 | Example 14 |
|---|---|---|---|---|---|---|---|---|
| Dye | IRT | 1.5 | 1.5 | 1.5 | 1.5 | 1.5 | | |
| | CVL | | | | | | 3.5 | 3.5 |
| | S-205 (2-Anilino-6-(N-ethyl-N-isobutylamino)-3-methylfluoran | | | | | | 0.5 | 0.5 |
| | 3-(4-Dimethylamino-2-ethoxyphenyl)-3-(1-ethyl-2-methylindol-3-yl)-4-azaphthalide | | | | | | | |
| | Blue203 | | | | | | | |
| Developer | 24DHBP | | | | | | 1.5 | 2.0 |
| | 244THBP | | | | | | 1.5 | 1.0 |
| | Propyl gallate | | | | | | | |
| Decolorizing agent | P3B | 7.5 | 7.5 | 7.5 | 7.5 | 7.5 | | |
| | Cholic acid | | | | | | | |
| Wax | Carnauba No. 1 | 2.5 | 2.5 | 2.5 | 2.5 | 2.5 | | |
| | Bischol 660P | | | | | | 4.0 | 4.0 |
| | Polypropylene wax | | | | | | | |

TABLE 2-continued

| | | | | | | | | | |
|---|---|---|---|---|---|---|---|---|---|
| | Charge controlling agent | LR147 | 1.5 | 1.5 | 1.5 | 1.5 | 1.5 | 1.0 | 1.0 |
| | Resin | Binder resin for toners | 67.0 | 82.0 | 77.0 | 72.0 | 67.0 | | |
| | | PTR7734 | | | | | | 65.0 | 65.0 |
| | | FTR-2140 | | | | | | 13.0 | 13.0 |
| | | SB-130 Styrene-butyl acrylate copolymer (acrylate content: 6 parts by mass) | | | | | | | |
| | Organic white pigment | Shienox F | | | | | | 10.0 | 10.0 |
| | | Shienox OWP | 20.0 | | | | | | |
| | | Shienox U | | 5.0 | 10.0 | 15.0 | 20.0 | | |
| | Titanium oxide | TAF-520 | | | | | | | |
| | Silica | R972 | 1.0 | 1.0 | 1.0 | 1.0 | 1.0 | | |
| | | Hydrophobic silica (/100 parts by mass) | | | | | | 1.0 | 1.0 |

TABLE 3

| | Name | Manufacturer | Example 15 | Example 16 | Example 17 | Example 18 | Example 19 | Example 20 | Example 21 |
|---|---|---|---|---|---|---|---|---|---|
| Dye | IRT | Showa Denko K.K. | | | | | | | |
| | CVL | | 3.5 | 2.0 | | | 2.0 | 2.0 | |
| | S-205 (2-Anilino-6-(N-ethyl-N-isobutylamino)-3-methylfluoran | Yamada Kagaku Co., Ltd. | 0.5 | | | | | | |
| | 3-(4-Dimethylamino-2-ethoxyphenyl)-3-(1-ethyl-2-methylindol-3-yl)-4-azaphthalide | | | | 2.0 | | | | 2.0 |
| | Blue203 | | | | | 4.2 | | | |
| Developer | 24DHBP | Sankyo Kasei Co., Ltd. | 4.0 | | | 6.6 | | | |
| | 244THBP | Sankyo Kasei Co., Ltd. | 1.0 | | | | | | |
| | Propyl gallate | | | 2.0 | 2.0 | | 2.0 | 2.0 | 2.0 |
| Decolorizing agent | P3B | Showa Denko K.K. | | | | | | | |
| | Cholic acid | | | | | | 16.0 | | |
| Wax | Carnauba No. 1 | | | | | | | | |
| | Bischol 660P | Sanyo Kasei Co., Ltd. | 4.0 | | | | | | |
| | Polypropylene wax | | | | | 5.0 | 1.0 | 1.0 | 1.0 |
| Charge controlling agent | LR147 | Japan Carlit Co., Ltd. | 1.0 | 1.0 | 1.0 | 1.0 | 1.0 | 1.0 | 1.0 |
| Resin | Binder resin for toners | Kao Corp. | | | | | | | |
| | PTR7734 | Eliokem | 63.0 | | | | | | |
| | FTR-2140 | Mitsui Chemicals, Inc. | 13.0 | | | | | | |
| | SB-130 | Sanyo Chemical Industries, Ltd. | | 85.0 | | | 68.0 | 84.0 | |
| | Styrene-butyl acrylate copolymer (acrylate content: 6 parts by mass) | | | | 85.0 | 73.2 | | | 84.0 |
| Organic white pigment | Shienox F | Hakkol Chemical Co., Ltd. | 10.0 | 10.0 | 10.0 | 10.0 | 10.0 | 10.0 | 10.0 |
| | Shienox OWP | Hakkol Chemical Co., Ltd. | | | | | | | |
| | Shienox U | Hakkol Chemical Co., Ltd. | | | | | | | |
| Titanium oxide | TAF-520 | Fuji Titanium Industry Co., Ltd. | | | | | | | |
| Silica | R972 | Nippon Aerosil Co., Ltd. | | | | | | | |

TABLE 3-continued

| | | | | | | | | |
|---|---|---|---|---|---|---|---|---|
| Hydrophobic silica (/100 parts by mass) | | 1.0 | 1.0 | 1.0 | 1.0 | 1.0 | 1.0 | 1.0 |
| | | Name | Comparative Example 1 | Comparative Example 2 | Comparative Example 3 | Comparative Example 4 | Comparative Example 5 | Comparative Example 6 |
| | Dye | IRT | 1.5 | 1.5 | 1.5 | 1.5 | 1.5 | |
| | | CVL | | | | | | 3.5 |
| | | S-205 (2-Anilino-6-(N-ethyl-N-isobutylamino)-3-methylfluoran | | | | | | 0.5 |
| | | 3-(4-Dimethylamino-2-ethoxyphenyl)-3-(1-ethyl-2-methylindol-3-yl)-4-azaphthalide | | | | | | |
| | | Blue203 | | | | | | |
| | Developer | 24DHBP | | | | | | 1.5 |
| | | 244THBP | | | | | | 1.5 |
| | | Propyl gallate | | | | | | |
| | Decolorizing agent | P3B | 7.5 | 7.5 | 7.5 | 7.5 | 7.5 | |
| | | Cholic acid | | | | | | |
| | Wax | Carnauba No. 1 | 2.5 | 2.5 | 2.5 | 2.5 | 2.5 | |
| | | Bischol 660P | | | | | | 4.0 |
| | | Polypropylene wax | | | | | | |
| | Charge controlling agent | LR147 | 1.5 | 1.5 | 1.5 | 1.5 | 1.5 | 1.0 |
| | Resin | Binder resin for toners | 87.0 | 82.0 | 86.0 | 83.0 | 66.0 | |
| | | PTR7734 | | | | | | 73.0 |
| | | FTR-2140 | | | | | | 15.0 |
| | | SB-130 | | | | | | |
| | | Styrene-butyl acrylate copolymer (acrylate content: 6 parts by mass) | | | | | | |
| | Organic white pigment | Shienox F | | | | 4.0 | 21.0 | |
| | | Shienox OWP | | | | | | |
| | | Shienox U | | | | | | |
| | Titanium oxide | TAF-520 | | 5.0 | 1.0 | | | |
| | Silica | R972 | 1.0 | 1.0 | 1.0 | 1.0 | 1.0 | |
| | | Hydrophobic silica (/100 parts by mass) | | | | | | 1.0 |

Although the organic white pigment was added internally by adding during the mixing and/or the melt-kneading of the binder resin, near-infrared absorbing material and decolorizing agent, the organic white pigment may also be added externally by adding after the melt-kneading.

Figure 2:
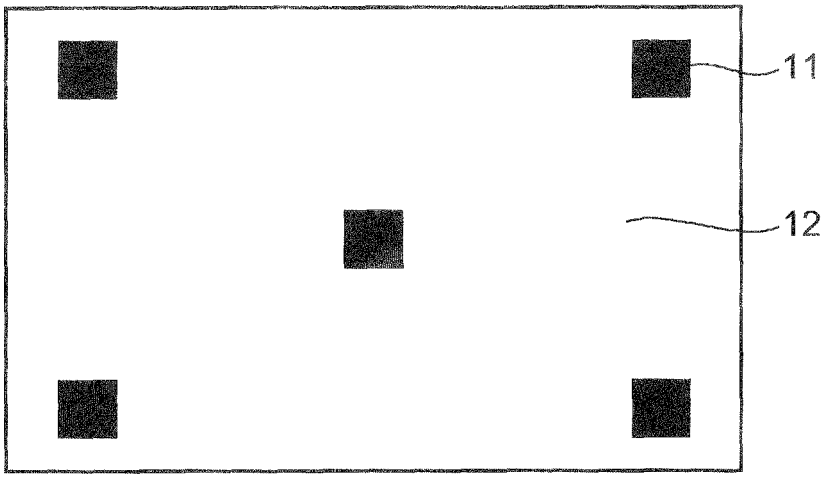
FIG. 2 is a drawing showing image samples printed by using the toners of Example and Comparative Example.

The photosensitive toners obtained in the above-mentioned Examples and Comparative Examples were each packed into a cartridge, and the cartridge was installed in the printer shown in FIG. 1. Printing was usually conducted according to a demand for printing by the printer in which an image is developed by the photosensitive toner at a developing unit 2, transferred to a transfer medium at a transfer unit 5 and fixed at a fixing unit 6. As a result, a printed product was obtained as shown in FIG. 2. As the transfer medium, P paper (manufactured by Fuji Xerox) was used.

Figure 3:
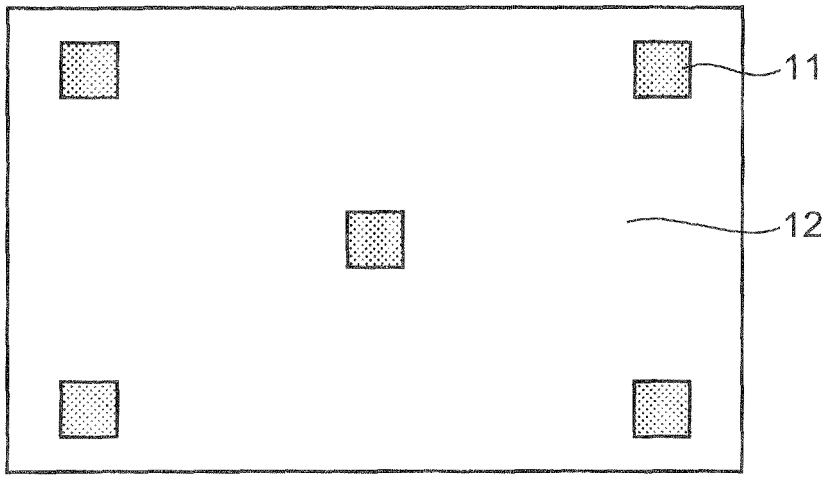
FIG. 3 is a drawing showing image samples obtained by erasing the image samples shown in FIG. 2 by means of the printer having an erasing function shown in FIG. 1.

Next, the samples printed by the photosensitive toners obtained in Examples 1 to 12 and Comparative Examples 1 to 5 were each erased. First, the printed transfer medium P was set in a cassette 7 of the printer shown in FIG. 1. An erasing LED head 4 and an erasing heater 3 of the printer were switched on, and the printed transfer medium P was put through a pathway 10 to effect erasing. Thereafter the transfer medium was ejected out of the apparatus. The obtained erased image sample is shown in FIG. 3.

The obtained image sample was measured by X-rite938 (manufactured by X-rite). Measured items are L*, a* and b* of a printed part 11 and a non-printed part 12 shown in FIG. 3.

Next, the samples printed by the photosensitive toners obtained in Examples 13 to 21 and Comparative Example 6 were each erased. The temperature of a thermostatic tank was set to 130° C., and erasing was conducted by heating for 120 minutes. The obtained erased image sample is as shown in FIG. 3. For these image samples, L*, a* and b* of the printed part 11 and non-printed part 12 were measured in similar manners.

Using the above-mentioned measured items, the visibility of each example was evaluated based on the following two points.

<Evaluation of Visibility>

The erasing value ΔE is obtained by the following calculation formula from the values of the printed part 11 and non-printed part 12 shown in FIG. 3.

$$\Delta E=\{(L^* \text{ of printed part } 11-L^* \text{ of non-printed part } 12)^2+(a^* \text{ of printed part } 11-a^* \text{ of non-printed part } 12)^2+(b^* \text{ of printed part } 11-b^* \text{ of non-printed part } 12)^2\}^{1/2}$$

The evaluation of visibility shows that a smaller value of ΔE indicates higher closeness to the base transfer medium, and the evaluation criteria are as follows.

Less than 3.0: ◎ very good
3.0 or more and less than 5.0: ○ good
5.0 or more and less than 7.0: Δ practically acceptable level
7.0 or more: × unusable level The results obtained by the above-mentioned evaluation methods are shown in the following Table 4.

TABLE 4

| | ΔE erasing value | Others |
|---|---|---|
| Example 1 | ○ | |
| Example 2 | ◎ | |
| Example 3 | ○ | |
| Example 4 | ○ | |
| Example 5 | ○ | |
| Example 6 | ◎ | |
| Example 7 | ○ | |
| Example 8 | ○ | |
| Example 9 | ○ | |
| Example 10 | ◎ | |
| Example 11 | ○ | |
| Example 12 | ○ | |
| Example 13 | ○ | |
| Example 14 | ◎ | |
| Example 15 | ◎ | |
| Example 16 | ◎ | |
| Example 17 | ○ | |
| Example 18 | ○ | |
| Example 19 | ◎ | |
| Example 20 | ○ | |
| Example 21 | ◎ | |
| Comparative Example 1 | Δ | Standard product |
| Comparative Example 2 | — | Abnormality in charging. Printing was impossible. |
| Comparative Example 3 | X | |
| Comparative Example 4 | X | |
| Comparative Example 5 | X | |
| Comparative Example 6 | X | |

It is understood from the above-mentioned Table 4 that the evaluation of visibility is excellent in all of the photosensitive toners of Examples 1 to 21 in which an organic white pigment was added in an amount of from 5 to 20% by mass of the mass of the toner. More specifically, in these Examples, the evaluation of visibility was from good to very good and the visibility of the printed part after erasing was close to that of the base transfer medium, which made it possible to prevent the identification and restoration of erased information. As a result, it is possible to recycle without uncomfortable feeling the transfer medium on which the print has been erased.

In addition, it is also possible to design photosensitive toners that are corresponding to various transfer media by adjusting the amount of the organic white pigment.

On the other hand, of Comparative Examples 1 and 6 in which the organic white pigment was not added, the sample obtained by the toner of Comparative Example 1 had poor visibility but was at a practically acceptable level, which was a standard product. In the sample obtained by the toner of Comparative Example 6, the visibility was at an unusable level, the visibility of the printed part after erasing was different from that of the base transfer medium, and yellowing of the printed part was observed after erasing. Furthermore, in the samples obtained by the toner of Comparative Example 4 in which the addition amount of the organic white pigment is too small and the toner of Comparative Example 5 in which the audition amount of the organic white pigment is too much, the evaluation of visibility was at an unusable level, the visibility of the printed part after erasing was different from that of the base transfer medium, and yellowing of the printed part was observed after erasing.

In addition, in the toner of Comparative Example 2 in which 5% by mass of titanium oxide, inorganic white pigment, was added instead of the organic white pigment, there was abnormality in charging, and thus printing could not be conducted. Furthermore, in the toner of Comparative Example 3 in which 1% by mass of titanium oxide was added, the visibility was at an unusable level, the visibility of the printed part after erasing was different from that of the base transfer medium, and yellowing of the printed part was observed after erasing.

Some embodiments of the present invention have been explained above, and all of these embodiments are encompassed in the scopes of the inventions as claimed in the claims and equivalents thereof.

What is claimed is:

1. An erasable electrophotographic toner comprising a binder resin, a near-infrared absorbing material, a decolorizing agent and an organic white pigment.

2. The erasable electrophotographic toner according to claim 1, wherein the organic white pigment is added in an amount of from 5 to 20% by mass of the mass of the toner.

3. The erasable electrophotographic toner according to claim 2, wherein the toner is obtained by a process comprising mixing and melt-kneading the binder resin, the near-infrared absorbing material and the decolorizing agent.

4. The erasable electrophotographic toner according to claim 3, wherein a charge controlling agent is further mixed during the mixing of the binder resin, the near-infrared absorbing material and the decolorizing agent, and the mass of the toner is the total mass of the binder resin, the near-infrared absorbing material, the decolorizing agent, the charge controlling agent, the organic white pigment and a wax.

5. The erasable electrophotographic toner according to claim 1, wherein the organic white pigment comprises at least one kind selected from the group consisting of a diphenylethylene-based compound, an ethylenediamine-based compound and a bis-styryl-based compound.

6. A method of producing the erasable electrophotographic toner of claim 1, comprising: mixing a binder resin, a near-infrared absorbing material and a decolorizing agent, melt-kneading the mixture obtained by the mixing, and adding an organic white pigment to the melt-kneaded mixture.

7. The method of producing an erasable electrophotographic toner according to claim 6, wherein the organic white pigment is added in an amount of from 5 to 20% by mass of the mass of the toner.

8. The method of producing an erasable electrophotographic toner according to claim 7, wherein a charge controlling agent is further mixed during the mixing of the binder resin, the near-infrared absorbing material and the decolorizing agent, and the mass of the toner is the total mass of the binder resin, the near-infrared absorbing material, the decolorizing agent, the charge controlling agent, the organic white pigment and a wax.

9. The method of producing an erasable electrophotographic toner according to claim 6, wherein the organic white pigment is added during she mixing and/or the melt-kneading of the binder resin, the near-infrared absorbing material and the decolorizing agent.

10. The method of producing an erasable electrophotographic toner according to claim 6, wherein the organic white pigment comprises at least one kind selected from the group consisting of a diphenylethylene-based compound, an ethylenediamine-based compound and a bis-styryl-based compound.

* * * * *